US005190510A

United States Patent [19]

Goodger

[11] Patent Number: 5,190,510

[45] Date of Patent: Mar. 2, 1993

[54] BENCH PRESS APPARATUS

[76] Inventor: John Goodger, 7 Minti Rd., Coram, N.Y. 11727

[21] Appl. No.: 755,482

[22] Filed: Sep. 5, 1991

[51] Int. Cl.[5] ..... A63B 21/078

[52] U.S. Cl. ..... 482/104

[58] Field of Search ..... 482/104, 1-9, 482/93, 106, 108, 142

[56] References Cited

U.S. PATENT DOCUMENTS

| | | | |
|---|---|---|---|
| 4,249,726 | 2/1981 | Faust | 482/104 X |
| 4,252,314 | 2/1981 | Ceppo | 482/104 |
| 4,253,662 | 3/1981 | Podolak | 482/104 |
| 4,256,301 | 3/1981 | Goyette | 482/104 |
| 4,650,186 | 3/1987 | McCreery et al. | 482/104 |
| 4,749,190 | 6/1988 | Jennings | 482/104 |
| 4,765,616 | 8/1988 | Wolff | 482/104 |
| 4,807,875 | 2/1989 | Tanski | 482/104 |
| 4,815,746 | 3/1989 | Ward, Jr. | 482/104 |
| 4,875,676 | 10/1989 | Zimmer | 482/104 |
| 4,949,959 | 8/1990 | Stevens | 482/104 |
| 4,998,721 | 3/1991 | Adders et al. | 482/104 X |
| 5,048,826 | 9/1991 | Ryan | 482/104 X |

*Primary Examiner*—Robert Bahr

*Attorney, Agent, or Firm*—Alfred M. Walker

[57] ABSTRACT

The bench press apparatus, includes a base, an elevating device and a lifting device to lift the weight of the barbell away from a user, and a knee activated switch to activate the lifting of the weight by means of one or more pulleys and a chain responsive to a motor connected with said knee activated switch to lift the weight of the barbells away from the user in a supine position.

8 Claims, 6 Drawing Sheets

BENCH PRESS APPARATUS

BACKGROUND OF THE INVENTION

This invention relates to exercise machines, specifically to a bench press apparatus with a built in hoist and safety switch to lift the accompanying barbell weights up and away from the fitness user.

Typical bench press apparatus' include a horizontal bench portion adjacent to a pair of vertical bars with notches to hold the barbell weights in between exercise use. These machines, however, do not adequately provide a relief mechanism to permit a user who is in a generally supine position, to elevate the barbell weights.

These other exercise machines have been sold commercially which are designed to hold the barbell weights above the user when the user is finished exercising by lifting the barbell weights. Such exercise is commonly known as bench press exercising. When a strenuous lifting activity such as bench press exercising is undertaken, the exercise user often gets tired and weak after exertion. However, the cycle of lifting barbell weights starts with the weight adjacent to the chest of the exercise user, whereafter the barbell weight is lifted upward and then released slowly downward to the chest of the user. The typical barbell device contains vertical bars with notches or shelves to hold the barbell weights up at a level consistent with the fully extended arms of the user. These machines do not, however, provide any means for the simultaneous removal of the exercise barbell weights away from the chest area of the user when confined by the weight of the barbell above the chest. The instant invention combines desirable features in a single unit to permit the mechanical elevation of the barbell weight away from the user, without the necessity of the user lifting the weight from the user's body with an additional expenditure of energy. A knee activated safety switch is provided, to instantly activate the lifting of weight away from the user, when the user is too tired or exhausted to manually lift the barbell weights upward away from the body.

SUMMARY OF THE INVENTION

It is the object of this invention to provide a bench press apparatus with a lifting apparatus confined to a single machine. This machine not only lifts the barbell weight away from the body, but also is activated from a user activated switch, thereby providing the user with substantially complete bench press exercise machine which lifts the barbell weight away from the exercise user's body.

A further objective of the instant invention is to provide a self-contained knee activated switch to lift the conventional barbell weights away from a user in distress or physical exhaustion. It is not uncommon for bench press users to realize that they cannot lift the barbell weights any more, yet the barbell weight is burdened upon the user in a helpless prone position.

The instant invention provides greater benefits than traditional bench press machines and eliminates the above mentioned risk of being caught under a weight which one cannot further lift up. A lifting means is provided to allow the user to lift the weight in a substantially vertical position, if he or she so desire. This will eliminate muscle and cardiovascular injury caused by the arm lifting the weights away from the user's chest when the user is in distress or exhausted in a vulnerable supine position.

This allows even individuals already inflicted with the above mentioned trapped supine position to stop their weight lifting fitness program without pain or any further injury. A knee activated switch means permits the lifting motion to be commenced with the minimum of physical stress. The lifting effort required to overcome the force that lifts the barbell away from the user creates benefits not found in conventional bench press devices.

To lift the weights, a chain hoist is looped around a series of pulleys. When a motor affixed to one end of the chain is activated by the knee activated switch, the chain is pulled so that the pulleys rotate counter clockwise, thereby lifting the load of the barbell weights upward. When the chain is moved in a reverse direction, the pulleys rotate clockwise and the load of the weight is lowered.

The unique combination of the above mentioned features allows the user to interrupt bench press exercising without having to simultaneously lift the weight manually away from the body, thereby reducing the risk of injury to the muscular or cardiovascular system.

BRIEF DESCRIPTION OF THE DRAWINGS

The invention will be better understood with reference to the drawings, in which.

DESCRIPTION OF PREFERRED EMBODIMENT

Figure 1:
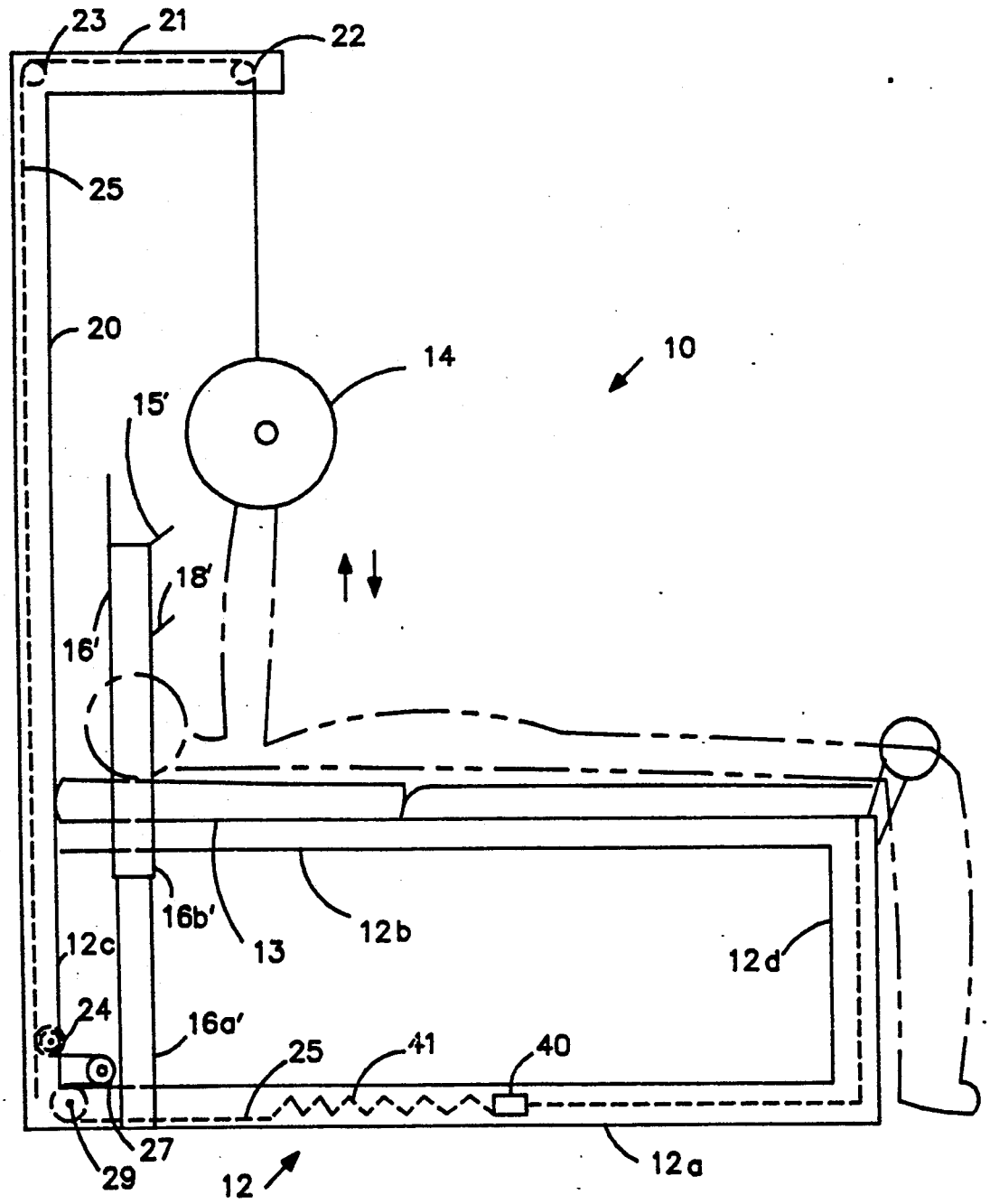
FIG. 1 is a side elevation view of a bench press apparatus according to the present invention.
Figure 2:
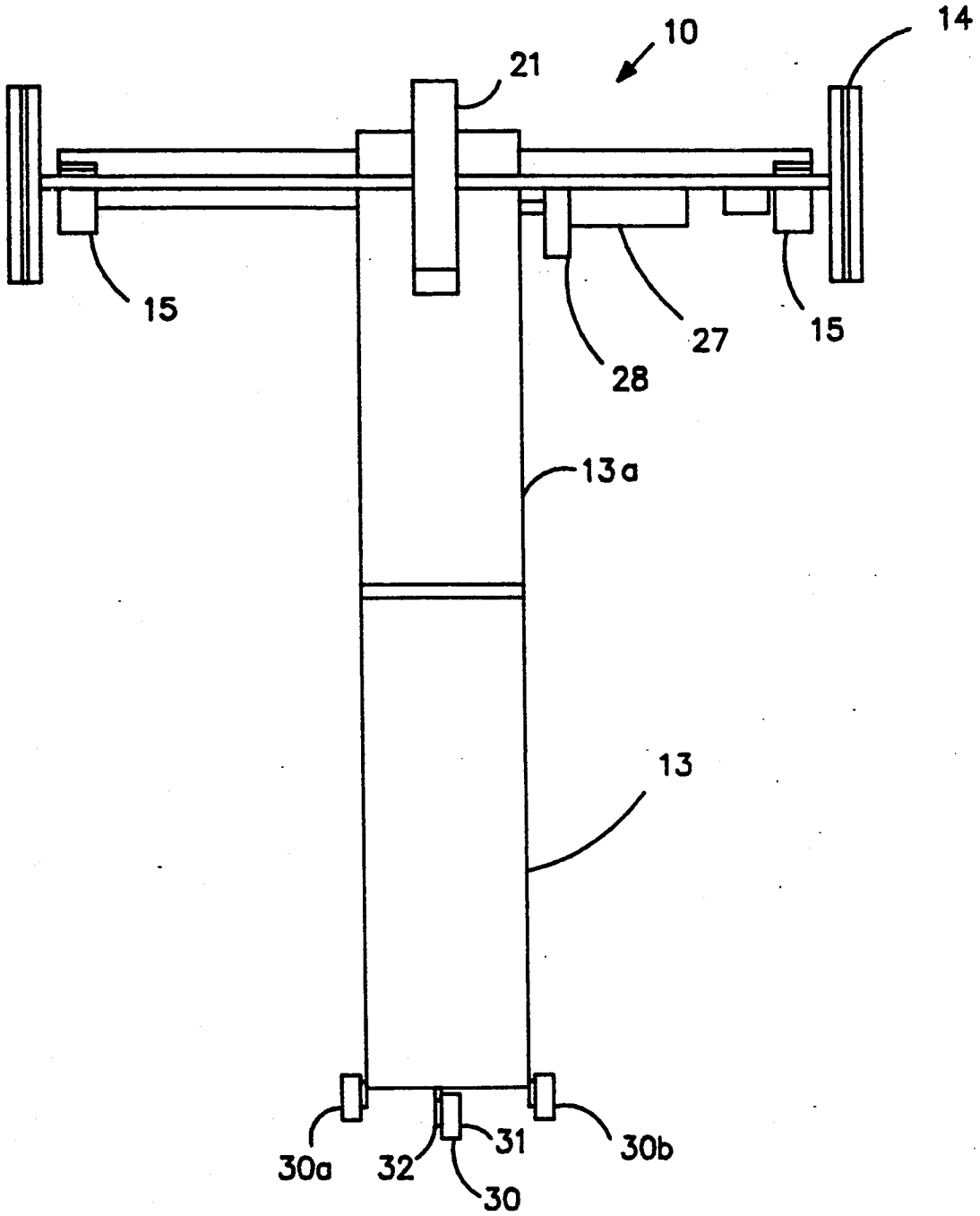
FIG. 2 is a top plan view of the bench press apparatus according to the present invention.
Figure 3:
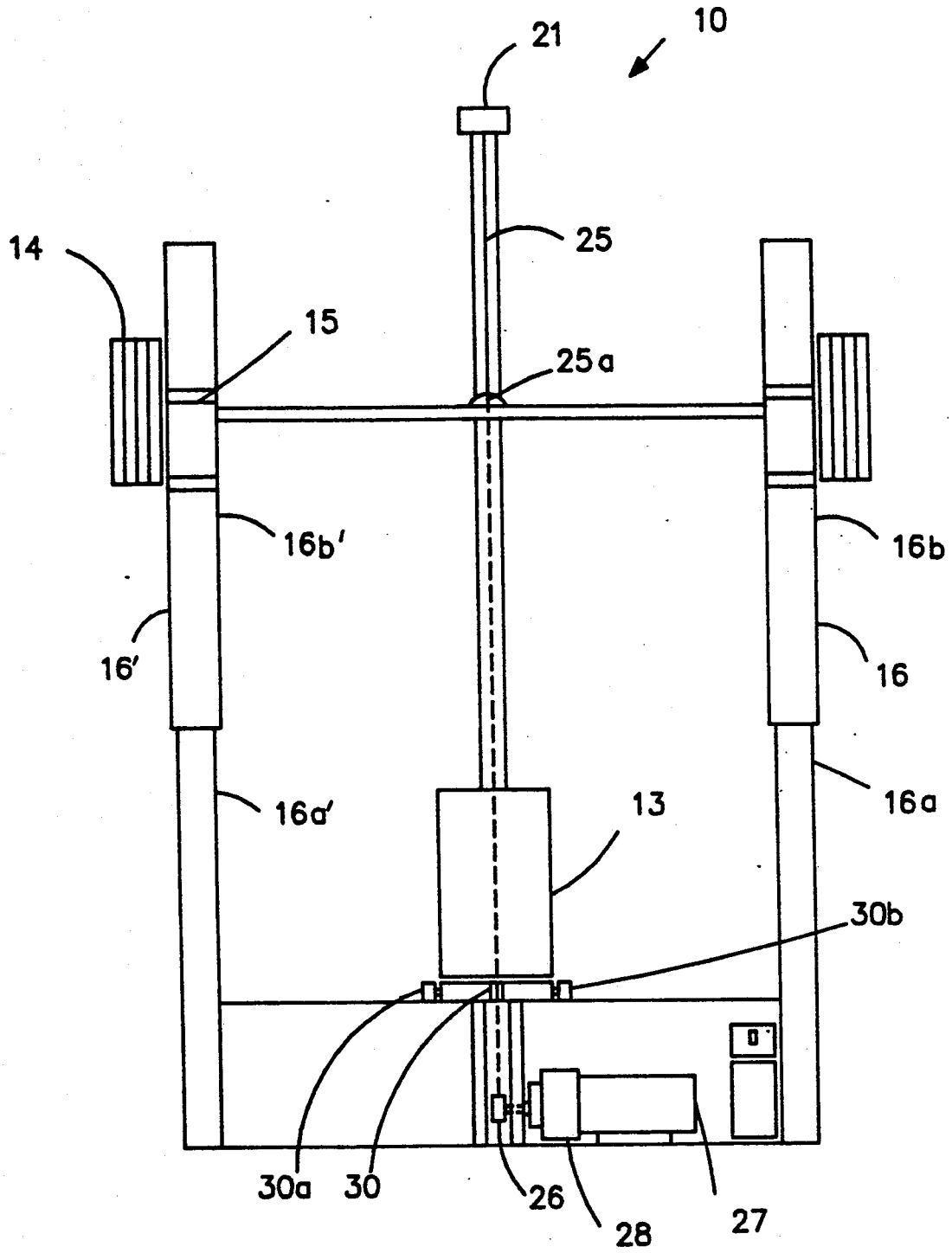
FIG. 3 is a front elevational view of the bench press apparatus according to the present invention.

In a preferred embodiment, as shown in FIGS. 1–5, a bench press apparatus machine 10 is supported on a horizontal foundation 12. As shown in FIG. 1, the base 12 is generally of a rectangular shape including a lower support member **12*a*, an upper horizontal support member 12*b* connected by two vertical members 12*c* and 12*d* which elevate horizontal bar 12*b* above the ground. While the configuration of support 12 is generally rectangular, it is contemplated that vertical support members 12*c* and 12*d* may include a pair of parallel support bars, such as is shown in FIG. 4A, with respect to support member 12*d*. As shown in FIG. 1, a user's support bench press pad 13 is provided above elevated horizontal member 12*b* to support a user in supine position. The support pad 13 may be raised in a conventional manner to provide an angled position for the user's back, as is depicted in FIGS. 3 and 4A. As shown in FIG. 1, bench press exercises are conducted by lifting of barbell weights which are designated as reference numeral 14. When not used, the weights 14 rest in primary support holding means 15 located upon upper vertical support members 16 and 16' including lower portions 16*a* and 16*a'* and upper portions 16*b* and 16*b'*, the tops of which upper portions 16*b* and 16*b'* includes primary support members 15 and 15' for holding barbell weight 14 in a rested stationary position above the user. Therefore, the user can safely and comfortably sit up from the supine position upon support pad 13 when completing a barbell lifting exercise routine. Safety support members 18 and 18' are provided approximately midway upon upper vertical support members 16b and 16b' to place the weight if the user cannot exert enough lifting force to place the barbell within support members 15 land 15'. Hoist support column 20, generally of hollow steel, extends upward from base portion 12 at a height greater than the height of the primary support 15 so as to elevate an extension arm 21 to extend forward from the column 20 and above the top of the vertical weight support members 16 and 16b. At the outer distal end of the extension support arm 21, the end of the support arm being measured in a direction away from column 20, there is provided first pulley 22. At the other inner proximal end of the support extension arm 21 adjacent to column 20 there is provided a second pulley 23, acting in concert with a third pulley 24, located below pulley 23, at the lower end of column 20. These three pulleys 22,23,and 24 act in concert to alternately lift or lower support cord member 25, generally a ¼" chain, up or down. At the distal end 25a of cord member 25, there is affixed the barbell weight 14. When the inventive device is viewed from the left side with the head portion of support mat 13 on the left and the leg portion of support mat 13 on the right, the cord member 25 rotates about pulleys 22, 23 and 24 in a counter clockwise rotation when the barbell weight 14 is being lifting up away from the user. The chain continues around a further pulley 26 attached to motor 27, which motor 27 activates the pulling and releasing of the cord member 25 up and down away from the user. The motor 27 is generally a drive motor of 115 volts, ¼ horsepower with torque 600 inch/pounds, such as a Dayton gear motor, which can be run continuously and is activated by a clutch 28 electrically connected to a knee activated control switch 30, such as a mushroom switch made by Cutler Hammer. The knee activated switch 30 typically has a mushroom shaped head 31 and extension bracket member 32, which switch 30 is electrically connected to a cable 33, connected to clutch 28 and motor 27. A further safety feature is the fact that the end of the chain 25, after rotating around the pulley 26 of the motor 27, rotates around a further pulley 29 and attaches to a spring based anchor attachment 40 with a coil spring 41, generally a carbide coil spring, to recoil and keep tension on the cord member 25**, such a chain.

When the user has extensively exercised and finds that the user is too tired or exhausted to lift the weight 14 away from the user's chest area, the user can activate knee activated control switch 30 between the knees of the user or alternatively either side position knee activated switches 30a or 30b to cause the motor 27 to activate, thereby pulling the cord member 25, such as a chain, around the pulleys 22, 23 and 24 in a counterclockwise direction so as to lift the weight 14 upward away from the user.

The invention can be used in a modified supine position, wherein rear support section 13a is elevated at an angle so as to elevate the chest of the user upward from the supine position. The support 13 is generally made of a flexible material provided with padding for maximum comfort of the user.

Connected to the knee activated switch 30 is mushroom portion 31 so as to insure the switch 30 activates in compliance with the user's quick horizontal movement of the knee while the user lies in the supine or semi-supine position with the weight 14 burdening the user upon the user's chest area.

The clutch assembly 28 generally includes an inlying clutch assembly for engaging the motor 27 with the cord member 25, such as a chain, when the knee activated switch 30 is activated.

As shown in FIGS. 1 to 5, the weight alternately moves up or down by rotation of power provided by motor 27 which is fastened to the lower portion 12 of the bench press apparatus. When the user moves his knee in a left or right movement, the switches 30a and/or 30b are activated and the pulley 26 about motor 27 is activated thereby pulling cord member 25, such as a chain, in a counter clockwise direction about pulleys 22, 23 and 24, thereby lifting the load of barbell weight 14 upward away from the user.

As a further safety means there is provided a coil spring 41 which keeps permanent tension on the chain 25. The coil spring is attached by anchor attachment means 40 to the lower portion 12a of base portion 12 of the device. The spring 41, exerts a continuous resistive force opposing the chain's up and don movement. Consequently the coil member 25 is in a constant state of tension to allow instantaneous movement and lifting of the weight 25 away from the user.

When the user is exercising in a supine position, the inventive device reduces any muscular or cardiovascular injury caused by the extra exertion of force to lift the weight of barbell weight 14 away from the chest area of the user, to allow the user to dismount from the supine position upon horizontal support 13. The device even allows users whose arms may have been injured to depart from the machine without further pain or risk of additional injury.

Figure 4:
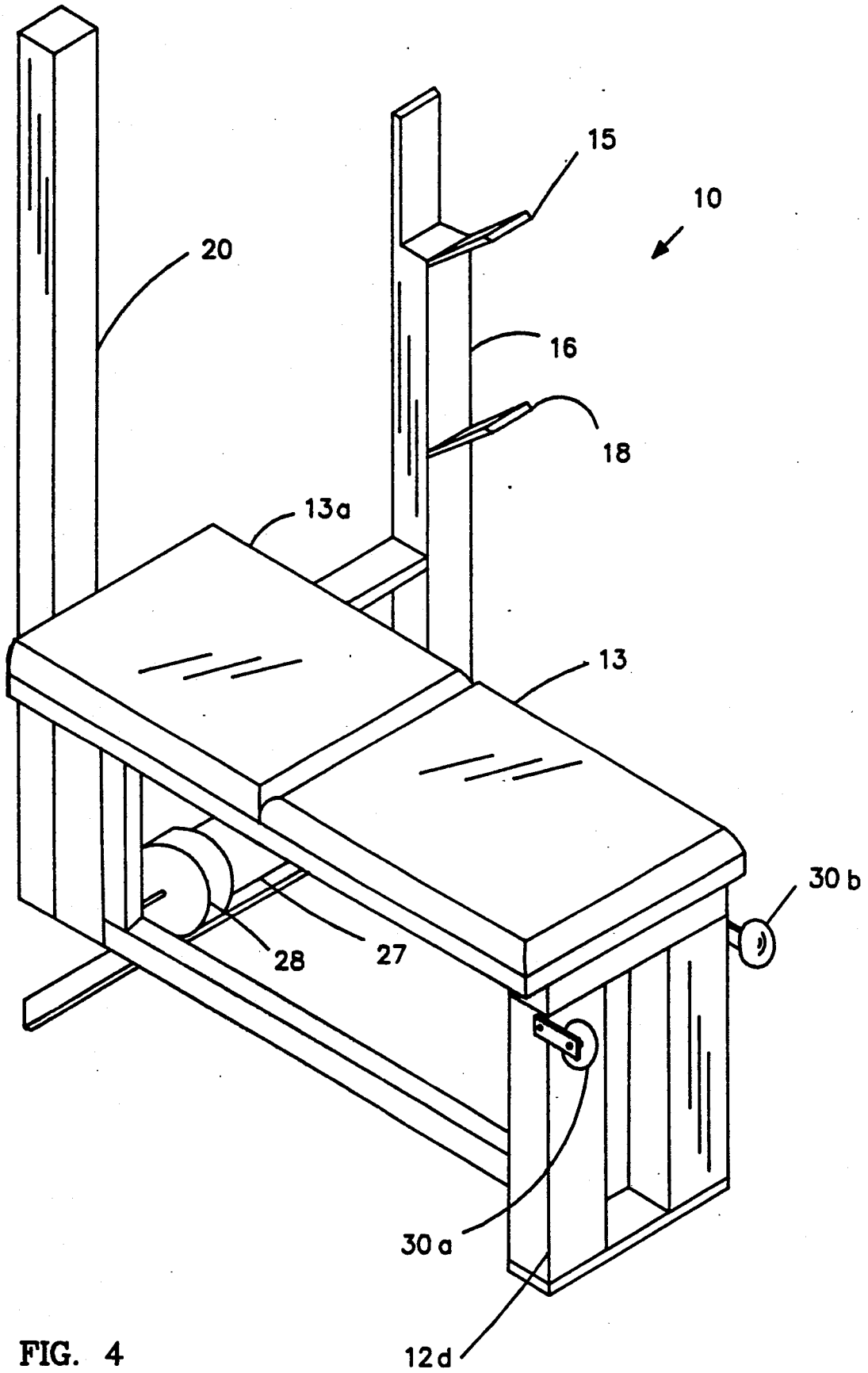
FIG. 4 is a close up perspective view showing the knee activated safety switch of the present invention.
Figure 4A:
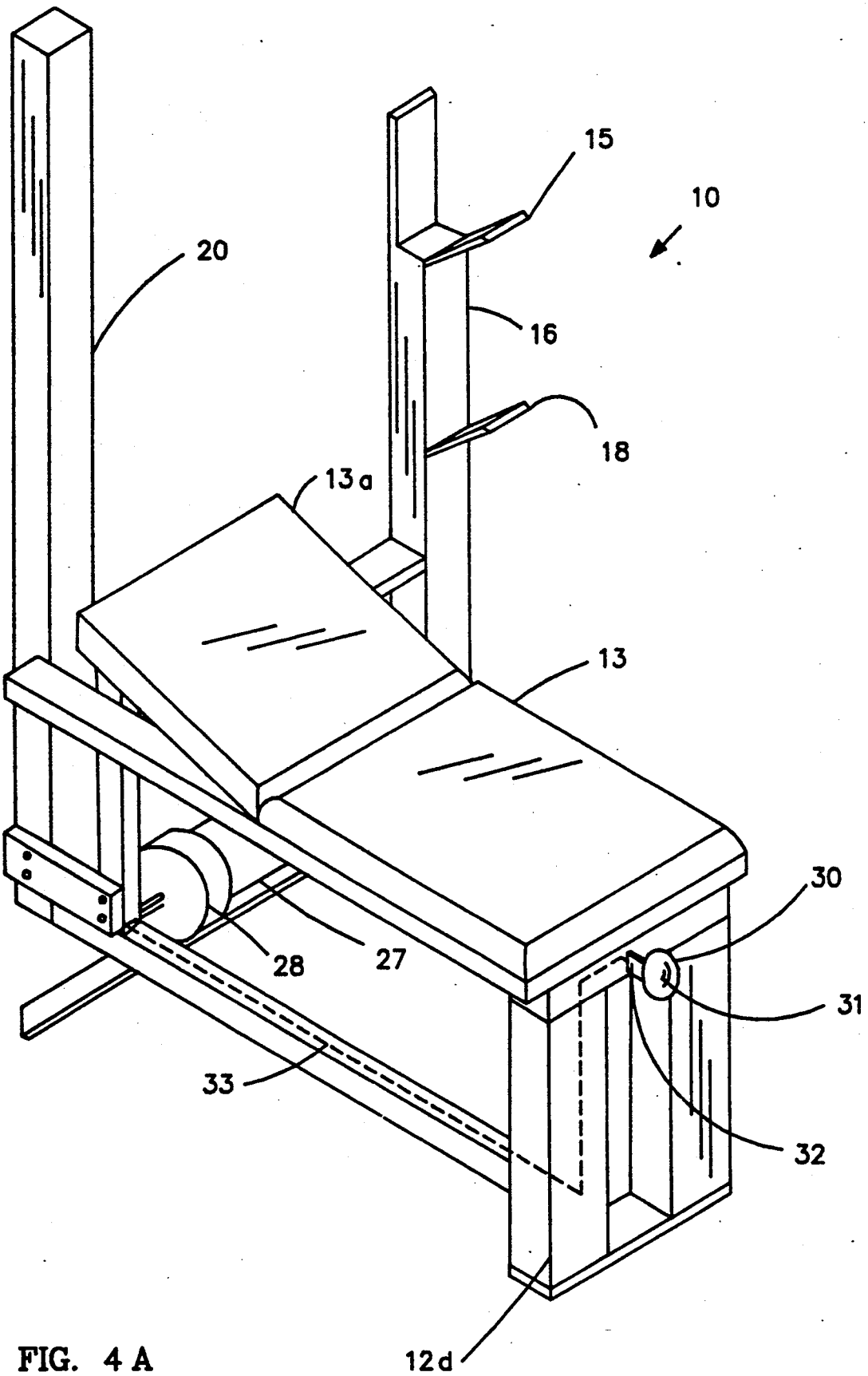
FIG. 4A is a close up perspective view, showing an alternative position for the knee activated safety switch of the present invention.
Figure 5:
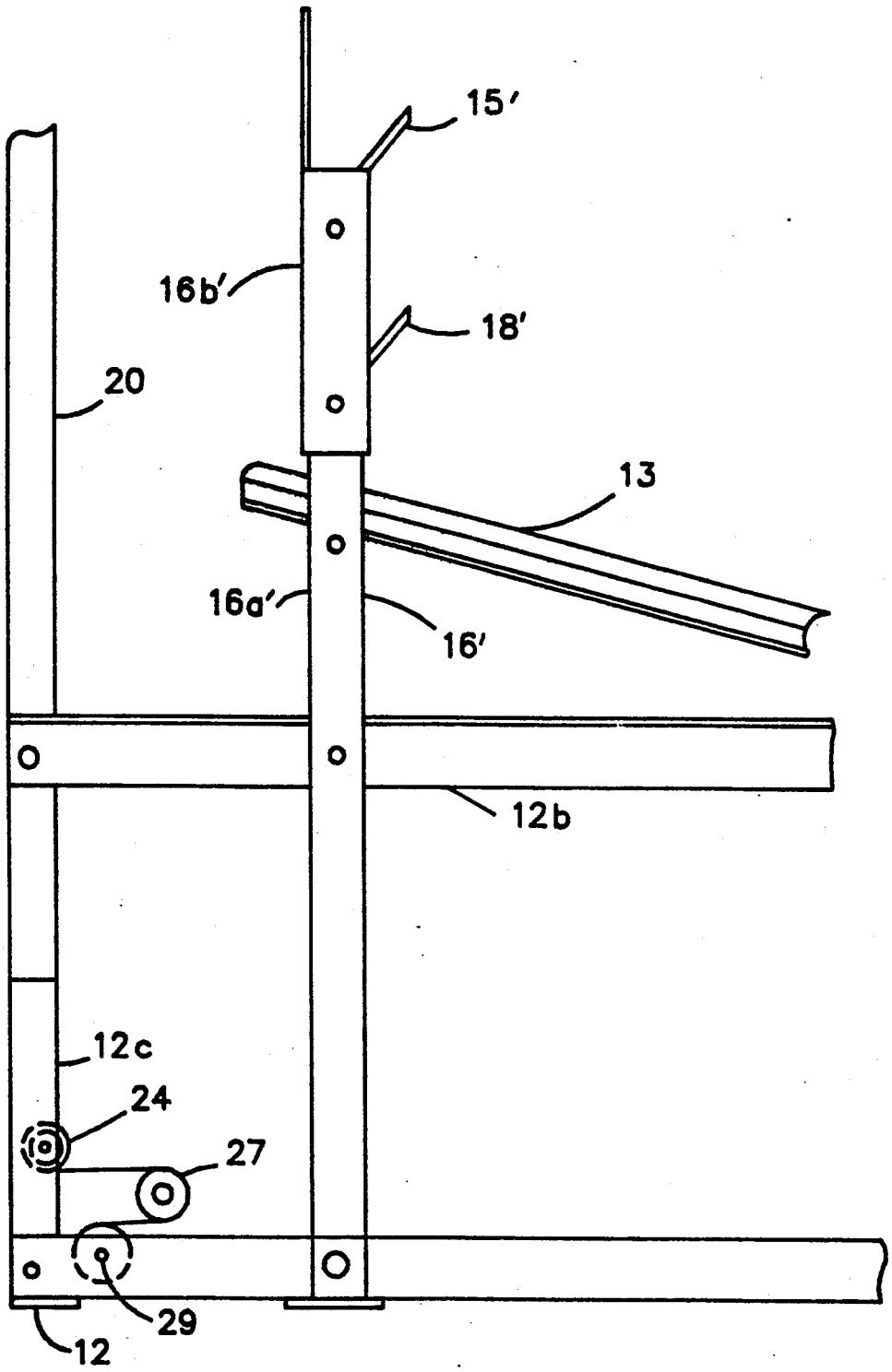
FIG. 5 is a close up side view of the motor portion of the present invention.

As noted in FIG. 4, the knee activated switch 31 is positioned in the center of support member 12b between the legs of the user so that the user may activate the switch by moving either knee inward. In the alternative, one or more switches 30a and 30b may be offset to one or both sides to activate the switch by the outward reflex movement of either knees or thighs of the user so as to cause the switch to make a complete electrical contact via cord 33 connected to motor 27. It is noted that various parts of the invention can be adjusted in size. For example, the portion 13a of the padded support 13 may be raised vertically at an angle as noted beforesaid. In addition, supports 16b and 16b' can be raised and lowered about lower support portion 16a and 16a' to adjust the height of the barbell supports 15 and 15' above the user. Furthermore, column 20 supporting extension member 21 can be extended upward and downward along a vertical axis by conventional telescoping means to raise or lower the desired vertical position of extension member 21 above the desired use position.

Upward vertically extending column 20 may alternatively include a pair of corresponding parallel upward extending columns (not shown) which are situated sufficiently apart so as not to restrict the entrance and exit of the person from the supine position.

Because the knee activated control switch 30 can activate motor 27 to pull the coil member 25 up with the weight 14 attached thereto, upward away from the user, the user can exercise without fear of overexerting him or herself and being caught with the barbell immediately on top of the user's chest, thereby trapping the user underneath the weight of the barbell. When the knee activated switch is utilized, the user benefits from the hoist lifting mechanism of the barbell weight 14 away from the body, freeing the user's body from the associated risks of trying to elevate the barbell weight manually away from the user's body when the user is exhausted or under distress. Alternate conventional timers (not shown) may be provided to record the exercise time and the number of lifts of the user. Such timers may also equipped with an audible alarm to inform the user that a preset length of exercise time has expired.

The present invention provides the user with the opportunity to exercise by bench press lifting of weight barbells while allowing for a knee activated hoist lifting of the weight away from the user, when the user desires to complete the exercise, by lifting the weight away from the chest area of the user. This position adjustment feature allows individuals to remain physically fit without the threat of any potential muscular or cardiovascular damage due to over exertion from the lifting the weight 14 away from the user's body.

It is to be understood that the invention is not limited to exact details of construction as shown and described, for obvious modification will occur to persons skilled in the art.

I claim:

1. An apparatus for training weight lifters in performing weight lifting exercise comprising:

a substantially horizontal bench plateform, said platform having at one end a head portion and at the other end a leg portion, said platform having an axis extending longitudinally from said head portion to said leg portion, and said platform supporting the head and torso of the weight lifter thereon in a generally horizontal position, such that the weight lifter's thighs may extend horizontally beyond said leg portion, the weight lifter's feet may rest on a floor, the weight lifter's legs may bend at the knees, and the weight lifter's knees may alternately move inward and outward from each other while the weight lifter's feet rest uninterrupted on the floor without the need to lift the feet up from the floor;

a support for a barbell weight;

a cord member attachable at one end to the barbell weight;

one or more pulleys mounted on the apparatus, said cord member rotatable about said one or more pulleys and connected at an other end to a base of said apparatus;

a motor for rotating said cord about said one or more pulleys; and, a weight support actuating means to permit the weight lifter to actuate a lifting of the barbell weight away from the weight lifter while the feet of the weight lifter rest uninterrupted on the floor and while the barbell weights are closely proximate to the chest area of the weight lifter, said weight support actuating means having one or more switches located in a position adjacent to said leg portion of said platform, said one or more switches horizontally and laterally oriented so as to be actuated by generally horizontal, lateral movement of the weight lifter's knees while the weight lifter's feet rest uninterrupted on the floor.

2. The invention as in claim 1 wherein said motor rotates in a clockwise direction thereby moving the cord member around in a counter clockwise direction around one or more pulleys and moves the weight at the end thereof up and away from the user.

3. The invention as in claim 1 wherein the motor further includes a continuously run motor, activated by a clutch connected to said knee activated switch.

4. The invention as in claim 3 further including an anchoring attachment attached to the base of the device and wherein said cord member is attached to said attachment by a coil spring, a means to recoil tension on said card member, said means including said coil spring connected between said attachment and said end of said cord member.

5. The invention as in claim 3 wherein said anchor attachment means includes a resistance means for resisting pull of the card member pulling the weight of the apparatus away from the user.

6. The bench press device as in claim 5 wherein said bench press means further includes an adjustable user support means so as to elevate the user at an angle above the horizontal prone position.

7. The invention as in claim 1 wherein there is provided a pair of knee activated switches on either side of the knees of the user.

8. The invention as in claim 1 wherein there is provided a knee activated switch between the knees of the user.

* * * * *